United States Patent [19]

Decuir, Sr.

[11] 4,089,371

[45] May 16, 1978

[54] PRODUCTION SHOE

[76] Inventor: Perry J. Decuir, Sr., P.O. Box 1154, New Iberia, La. 70560

[21] Appl. No.: 730,596

[22] Filed: Oct. 7, 1976

[51] Int. Cl.[2] ..... E21B 17/14; E21B 43/00

[52] U.S. Cl. ..... 166/242; 166/328; 166/241

[58] Field of Search ..... 166/327, 242, 328, 312

[56] References Cited

U.S. PATENT DOCUMENTS

| | | | |
|---|---|---|---|
| 672,556 | 4/1901 | Hunick | 166/242 |
| 1,431,872 | 10/1922 | Cater | 166/242 |
| 1,600,956 | 9/1926 | Duckworth | 166/328 |
| 1,914,251 | 6/1933 | Gordon | 166/242 |
| 2,362,403 | 11/1944 | Reynolds | 166/312 |

*Primary Examiner*—James A. Leppink
*Attorney, Agent, or Firm*—Arnold, White & Durkee

[57] ABSTRACT

An internally tapered production shoe for securing to the bottom of production tubing having no sharp projections, thereby permitting the removal of wireline tools from an initial location below the shoe without snagging. The shoe is particularly useful for slanted boreholes. The wireline tool being carried by a wheeled locomotive further minimizes attendant friction problems.

4 Claims, 6 Drawing Figures

FIG. 3
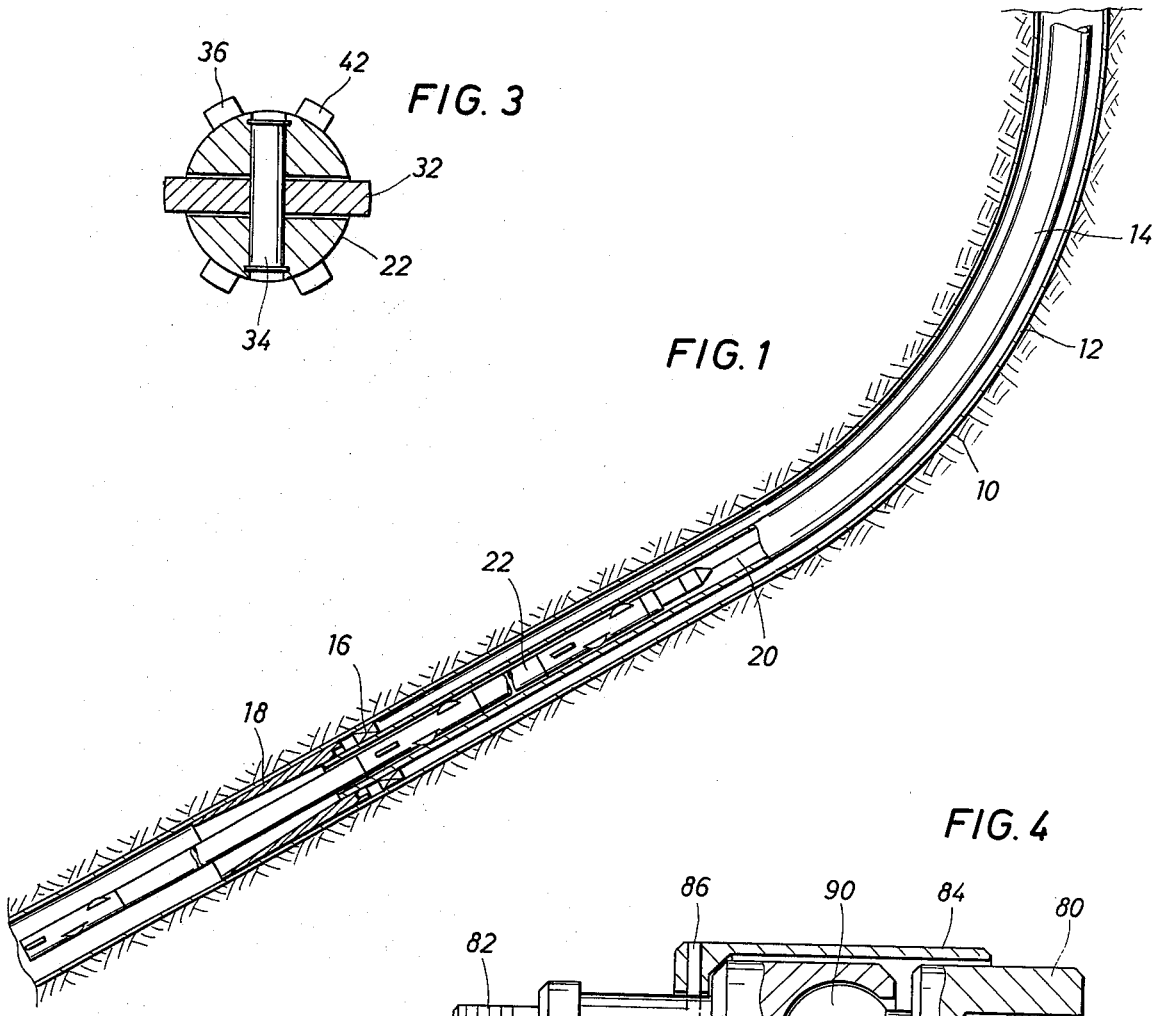
FIG. 1
FIG. 4
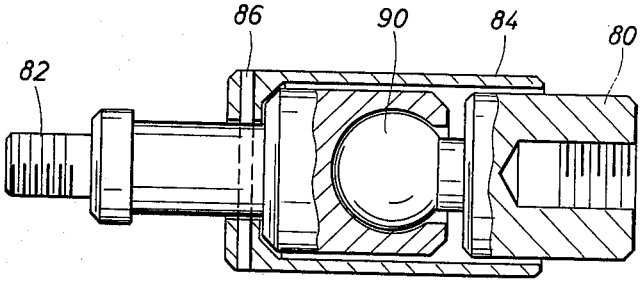
FIG. 2
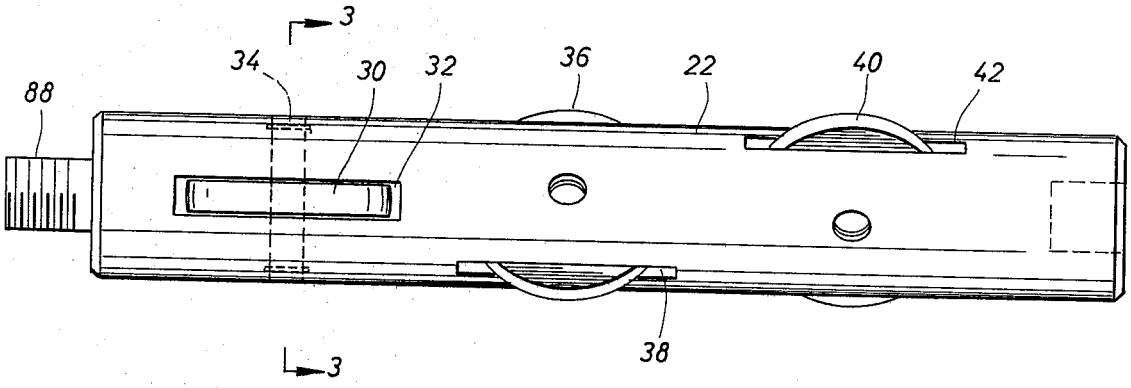

PRODUCTION SHOE

BACKGROUND OF THE INVENTION

1. Field of the Invention

This invention relates to directional drilling apparatus and more specifically to a configuration of a production shoe and a wireline tool particularly advantageously suited for operation with a directionally drilled or slant drilled borehole.

2. Description of the Prior Art

Cable-suspended well tools, commonly referred to as "wireline tools" are employed in borehole operations for a myriad of purposes. For example, it is not uncommon for parts of the drill string, tubing, packers and other component parts of oil and gas well apparatus used for completing and operating in a borehole to become loose and fall to the bottom of the well, often below the end of the well tubing. When this occurs, it is common practice to lower a wireline "fishing tool" to hook or otherwise attached to the "lost" apparatus so that it may be raised and retrieved. The raised apparatus commonly has projections and irregular shoulders which snag with the bottom or lowermost parts of the well tubing and cause jamming. Upward pulls to hopefully break the jam often cause wireline breakage, breakage of the wireline tool or the apparatus attached by the tool.

Although fishing tools are one type of wireline tool, there are many others, all of which when raised past the lower end of the well tubing are in danger of snagging or sticking.

When the borehole casing is not substantially vertical, and there are many extremely angular boreholes in the field as a result of intentional directional drilling, as well as those slanted because of unintentional slant drilling, then the snagging problems are accentuated. This is because the retracted tool scrapes the internal part of the borehole casing and does not dangle or suspend itself in a centralized fashion. Hence, if there are any projections on the lower side of the slanted borehole, the retracted tool will surely encounter them.

Skillful wireline tool operators by such manipulations as backing off, jiggling and rotating the tool are able to overcome some of the shortcomings just described. But not all sticking problems can be overcome by such skillful tool operation, resulting in losses and down time, which are reduced and virtually eliminated with respect to lower well tubing projections by the present invention. Further, the need for a highly skilled and patient operator is eliminated.

Therefore, it is a feature of the present invention to provide an improved means for reducing the sticking of retracted wireline tools.

It is another feature of the present invention to provided an improved means for centralizing retrieved wireline tools to prevent snagging on the lower end of a well tubing through which the wireline tools are lowered and then raised.

It is still another feature of the present invention to provide a valving means attached to the lower end of a well tubing that allows the pressurizing of the tubing for lowering it, the setting of well packers, the testing of the production tubing and the like, which can then be subsequently sheared free to permit lowering and retrieval of wireline tools therethrough without snagging.

SUMMARY OF THE INVENTION

A preferred embodiment of the present invention includes a well tubing production shoe having a downwardly and outwardly flaring internal surface for providing minimum resistance to wireline tools moved upward therethrough, particularly important for operation of wireline tools in slanted wells. The well tubing shoe may conveniently be equipped with a shear-pin mounted valve arrangement for permitting the pressurizing of the well tubing for various purposes. Pressurizing above a predetermined limit causes the shear-pins to shear thereby releasing or blowing the valve arrangement. This permits the ready passage through of the tubing and the shoe connected thereto of a wireline tool. The most satisfactory wireline tool is one fitted with wheels to minimize friction and to centralize the tool, even in a directionally drilled well having a non-vertical borehole segment in the vicinity of the shoe. Such a tool carrier is sometimes referred to as a "locomotive."

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the appended drawings illustrate only a typical embodiment of the invention and are therefore not to be considered limiting of its scope, for the invention may admit to other equally effective embodiments.

In the Drawings:

FIG. 1 is a cross sectional diagram of a directionally drilled borehole with a production tubing and shoe therein in accordance with the present invention. A wheeled wireline locomotive is also illustrated, such locomotive being raised therethrough.

FIG. 2 is a detailed section of a preferred embodiment of a wheeled wireline locomotive such as illustrated in FIG. 1.

FIG. 3 is a cross sectional view taken at section 3—3 of FIG. 2.

FIG. 4 is a detailed section of a preferred embodiment of a knuckle joint for joining together sections of the wheeled wireline locomotive illustrated in FIGS. 1 and 2.

DESCRIPTION OF THE PREFERRED EMBODIMENT

Figure 5:
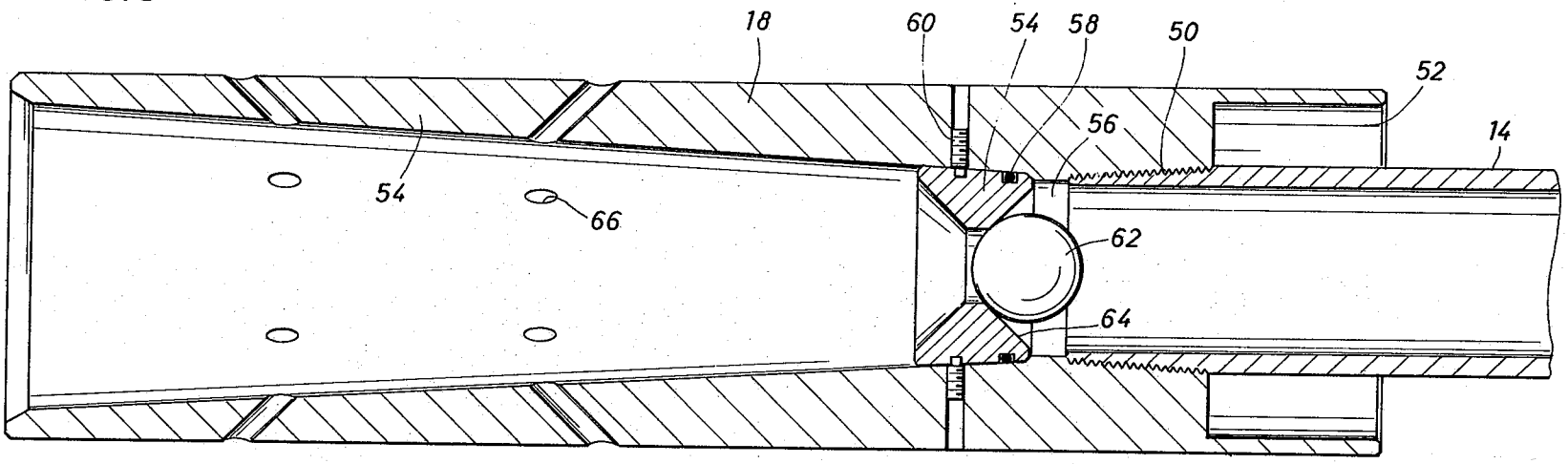
FIG. 5 is a cross sectional view of a preferred embodiment of a production shoe in accordance with the present invention during the time it is being set in place and while its still includes a valve arrangement.

Referring now to the drawings in first to FIG. 1, a section of a typical directional or slant borehole 10 is shown having a casing 12 already cemented in place. A production tubing 14 conforms to the borehole so that below the generally vertical portion thereof the borehole is continuing at an angle of at least approximately 72°. Above the illustrated borehole section, it is typical for the hole to have been drilled approximately vertical to a depth of about 3000 feet. Starting at that point, a typical slant-drilled well is directionally drilled at a rate of about 1° per 100 feet, until the desired rate is established.

The production tubing is secured in place with respect to casing 12 via packers 16. Of course, other packers may be located at other locations. Secured to the end of the production tubing is a production shoe in accordance with the present invention, which will be described more in detail hereinafter. The casing is shown continuing below the production shoe; however, in any particular installation the casing may terminate in the approximate vicinity of packers 16.

The production tubing is shown in cutaway illustration to reveal a wireline tool, such as a fishing tool locomotive, connected to wireline 20. For convenience, particularly in a slant well situation such as the one illustrated, the wireline tool is carried by locomotive 22, which includes a plurality of rollers to minimize the friction between the locomotive and the production tubing.

The wireline tool typically comprises a plurality of sections joined together to form a wireline tool string. Knuckle joints are used in such a string to join the sections together. A convenient knuckle joint for such purpose is illustrated in FIG. 4. Basically, such a joint comprises a box 80, a pin 82 and a sleeve 84 secured to pin 82 by a plurality of shear pins 86. Box 80 is centrally internally threaded to receive a pin 88 of a locomotive section, the opposite end being shaped to form ball 90. Pin 82 receives ball 90 in a mating socket. The socket housing part of pin 82 has forwardly positioned reducing shoulders for seating with an accommodating structure of sleeve 84, this accommodating structure presenting the greatest thickness of the sleeve for receiving shear pins 86.

It may be seen that the sleeve arrangement allows the string to have the necessary flexibility for traveling in a section that may be slanted even to be more horizontal than vertical. However, the flexibility is limited by the sleeve so that should any one or more sections of the sectioned tool by overweight or imbalanced, dragging of one or more sections will not occur.

As is illustrated most clearly in FIG. 2, it may be seen that the rollers are spaced conveniently in even fashion about the circumference or periphery of the locomotive.

A convenient and efficient means of giving the maximum number of surfaces for the rollers or wheels of the locomotive, only three wheels are used to give six bearing surfaces at uniform positions around the locomotive. Wheel 30 operates within a slot 32 and rotates about axis 34, which axis is normal to the elongate axis of locomotive 22. The axis may be secured in locomotive 22 by any convenient arrangement, such as by snap rings.

At a second location displaced one-third of the circumference from wheel 32, a similar wheel 36 is secured, this location also being longitudinally displaced to provide operation within slot 38, as illustrated. At another or third longitudinal location on the locomotive, a third wheel 40 is operably secured in place in slot 42. Hence, it may be seen from FIG. 3, that the three wheels provides six bearing surfaces evenly distributed around the periphery of locomotive 22.

It may further be seen that in operation, when the wireline tool is riding on the internal surface of the slanted production shoe, only two of the wheels normally carry any appreciable load at any given time. Even though the locomotive may rotate so that different wheels come in contact with the surface of the production shoe from time to time, any given wheel will be riding only on one side so that there is no opposing force that will be exerted, even though it may be seen that the wheels stick out on both sides of the locomotive through the slots in which they operate.

Now referring to FIG. 5, a detail drawing of production shoe 18 is illustrated. The well tubing shoe is threadedly connected in conventional arrangement to production tubing 14 at location 50. On the production tubing side of the threaded connection is an internal trap 52 for catching lost packer pieces and other items that may fall between the casing and the production tubing above the production shoe.

The lower or downwardly directed internal surface 54 of the production shoe flares frusto-conically outwardly. Typically, the flare or taper rises at 13/16 inches per foot.

A valve arrangement is located at the top of the taper which has been just been described. This valve arrangement in the production shoe comprises body member 54 located just below neck 56 with respect to the inside surface of the taper. O-ring 58 seals the body member against leakage therearound and a plurality of shear-pins 60 secure body member 54 to production shoe 18. Ball 62 completes the valve arrangement and is located to mate with seat 64 of the body member, in conventional fashion.

When the production tubing with the production shoe attached thereto is lowered through the casing, the fluids, both liquid and gas, can easily flow upward past seat 64, ball 62 normally not being initially present. Ball 62 is run or dropped in the production string and pumped to seat 64 at the appropriate time. If extra pressure is needed to encourage the production tubing down hole, ball 62 will permit pressure to be applied thereto. When the production shoe is in its final location, pressure may be applied to the tubing arrangement for such operations as setting up packers, testing of the tubing against leakage and the like. When it is desired to remove the ball arrangement because it is not longer needed in the completed tubing arrangement, excessive pressure may than be applied above a predetermined limit so as to blow out the valve arrangement through the shearing of pins 60. The ball and seat arrangement then merely drops to the bottom of the hole. Alternatively, the valve arrangement may be forced out by dropping a weight thereagainst.

One other structure is included in production shoe 18. These are holes 66 located at a plurality of positions about the tapered part of the shoe. Holes 66 are angled at approximately 45° with respect to the outside surface of the shoe, the row of holes in a plane normal to the elongate axis of the shoe nearest the end of the shoe being angled at approximately 45° with the external surface thereof and the other row being angled at an opposing 45°. Ordinarily, production shoe 18 is retrievable with the production string and packers and is set in place above the production perforations in the casing. However, before the setting of the packers, it may be desirable to lower the production string temporarily and without the setting of packers so that shoe 18 is temporarily at a depth below the point of production perforation. This operation ensures proper depth or open hole to the production perforation point. Holes 66 ensure against the premature setting of the packers from a pressure differential occurring from circulating fluids while the shoe is at the bottom depth. Hence, these holes provide pressure relief. Further, they provide the required perforations for cementing the shoe in place with cement slurry in conventional fashion.

The dimensions which are typical for a shoe such as has been described include an overall length dimension of approximately 24 inches for the shoe including an 18 inch length for the internal tapered portion. The overall width is about 6.4 inches. The production shoe is normally proportional in size with the casing annulus to reach the desired depth. A clearance of approximately ½ inches is desirable in relation to the size of the annulus. Neck dimension 56, located just above the body member of the valve arrangement, is approximately 3⅛ inches, or slightly larger than the production tubing at location 50 and smaller than surface 54 at its smallest diameter. It should be noted that the lower or tip end of the shoe is gently rounded so as to present no shoulders or other sharp edges for tools being raised from below the production shoe back through it.

Now referring to FIG. 1 again, it may be seen that a wireline tool 22 which is lowered through the production tool and raised back through it, such as with a fishing tool, will easily ride back through the tapered part of the shoe without requiring jiggling and without snagging on any shoulders. When the tool is sufficiently drawn within the production shoe, as shown in FIG. 1, the wireline tool is approximately centered within the production shoe without problem.

It should be noted that the boreholes are sometimes slanted to 70° or more with respect to vertical. Because of the weight of the wireline tool, were it not for the production shoe configuration which has just been described, removal of the wireline tool without damage to the tool or the production tubing or without losing the load to be removed, is an extremely chancy situation. With the production shoe arrangement, the difficulties are removed.

Figure 6:
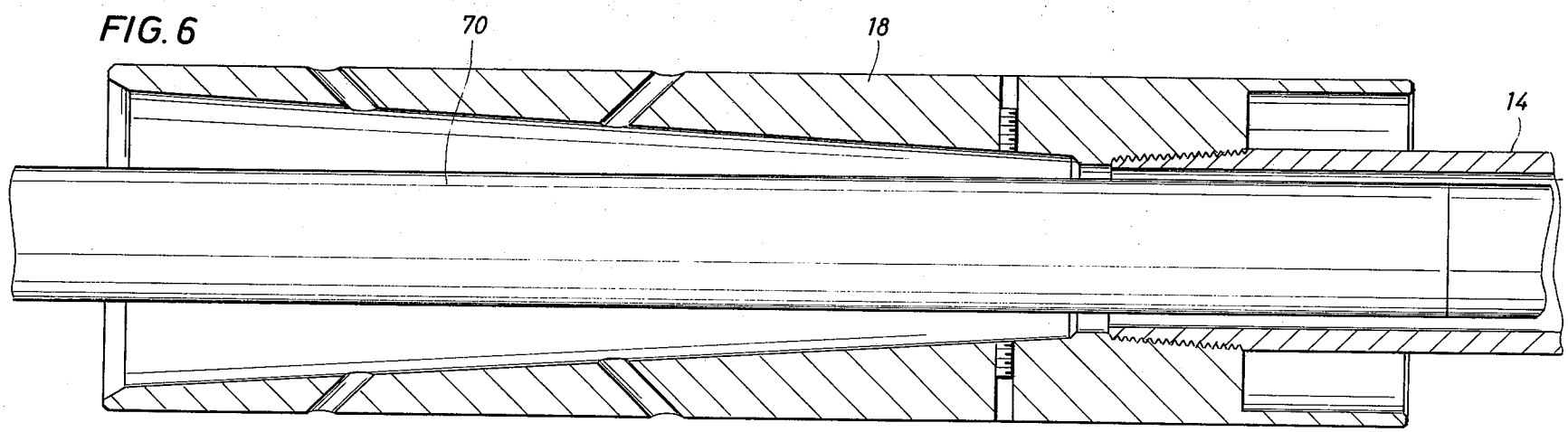
FIG. 6 is a cross sectional view of the embodiment shown in FIG. 4 after the valve arrangement thereof has been sheared or blown therefrom, the shoe being used in conjunction with a suitable wireline tool.

FIG. 6 illustrates a close up operation of a tool which does not include the convenient wheels on a locomotive. In such an embodiment and assuming a slant or somewhat horizontal casing, the wireline tool would have a tendency not to be centered and hence would be dragging in the shoe on the lower side. However, even without wheels, it may be seen that there are no sharp corners or projections which would prevent removal of the wireline tool 70. Such a tool would still be centralized before it got to the main part of the production tubing attached to the production shoe.

While a particular embodiment of the invention has been shown, it will be understood that the invention is not limited thereto, since many modifications may be made and will become apparent to those skilled in the art.

What is claimed is:

1. For use in a directionally drilled borehole which has a production tubing and a casing disposed within said borehole, said production tubing being disposed within said casing, a well tubing shoe comprising:

a downwardly and outwardly flaring, frusto-conical internal surface for providing minimum resistance and centralizing of wireline tools during their passage through the well tubing shoe and production tubing, the lowermost end of said internal surface having rounded corners;

means for connecting the well tubing shoe to the production tubing; and a valve for permitting fluid pressurizing of the production tubing disposed within the well tubing shoe, said valve including means for releasably securing said valve within the well tubing shoe so that upon application of excessive pressure above a predetermined limit, the valve will be forced from the well tubing shoe and will drop to the bottom of the borehole.

2. The well tubing shoe as described in claim 1 wherein the valve comprises a body member having a tapered seat formed therein and a ball which mates with the seat.

3. The well tubing shoe as described in claim 2 wherein the means for releasably securing the valve within the well tubing shoe comprises a plurality of shear-pins.

4. The well tubing shoe as described in claim 1 further including a plurality of holes disposed at a plurality of positions about the downwardly and outwardly flaring, frusto-conical internal surface of the well tubing shoe, said holes providing pressure relief.

* * * * *